US012454434B2

(12) United States Patent
Massotte et al.

(10) Patent No.: US 12,454,434 B2
(45) Date of Patent: Oct. 28, 2025

(54) SYSTEM FOR THE LOADING OF YARN PACKAGES ON A CREEL ASSEMBLY

(71) Applicant: Superba SAS, Mulhouse (FR)

(72) Inventors: Philippe Massotte, Gueberschwihr (FR); Baptiste Tredan, Illzach (FR)

(73) Assignee: Superba SAS, Mulhouse (FR)

( * ) Notice: Subject to any disclaimer, the term of this patent is extended or adjusted under 35 U.S.C. 154(b) by 0 days.

(21) Appl. No.: 18/593,454

(22) Filed: Mar. 1, 2024

(65) Prior Publication Data

US 2024/0300776 A1 Sep. 12, 2024

(30) Foreign Application Priority Data

Mar. 10, 2023 (EP) ..... 23315045

(51) Int. Cl.
*B65H 67/02* (2006.01)
*B65H 67/06* (2006.01)

(52) U.S. Cl.
CPC ..... *B65H 67/02* (2013.01); *B65H 67/065* (2013.01); *B65H 2701/31* (2013.01)

(58) Field of Classification Search
CPC ..... B65H 2701/31; B65H 67/064; B65H 67/065; B65H 49/16; B65H 67/02; B65H 67/06; B65H 67/0405; B65H 2301/41734; B65H 2405/422
See application file for complete search history.

(56) References Cited

U.S. PATENT DOCUMENTS 4,630,435 A * 12/1986 Igel ..... D01H 9/005 57/276
4,783,021 A * 11/1988 Nagasawa ..... D02H 1/00 414/280
5,829,950 A 11/1998 Alder
(Continued)

FOREIGN PATENT DOCUMENTS

DE 8321639 U1 7/1985
DE 4213049 A1 * 10/1992 ..... B65H 67/064
EP 0595208 A2 * 5/1994 ..... B65H 67/065
(Continued)

OTHER PUBLICATIONS

Europe Appl. No. 23315045.7, Written Opinion and Search Report, Jul. 29, 2023, 6 pages.

*Primary Examiner* — Gregory W Adams
(74) *Attorney, Agent, or Firm* — Kilpatrick Townsend & Stockton LLP

(57) ABSTRACT

Disclosed is a system for the loading of yarn packages on a creel assembly. The system may include a creel assembly with at least one lateral face having a plurality of receiving bullhorns arranged outwardly according to a horizontal axis to engage a respective yarn package, and a loading device movable along a path arranged along the creel assembly. The loading device may include a detection means to identify an empty receiving bullhorn of the creel assembly, a positioning means to adjust a bullhorn carrying a yarn package to be loaded onto the creel assembly so that the free end of this bullhorn is placed in front of the free end of the empty receiving bullhorn of the creel assembly, and a transfer mechanism for the effecting translation of the yarn package to the empty receiving bullhorn of the creel assembly.

10 Claims, 2 Drawing Sheets

(56) References Cited

U.S. PATENT DOCUMENTS

| | | | | |
|---|---|---|---|---|
| 6,769,854 | B2 * | 8/2004 | Wolf | B65H 67/065<br>414/910 |
| 10,590,581 | B1 * | 3/2020 | Weiner | B65H 57/12 |

FOREIGN PATENT DOCUMENTS

| | | | |
|---|---|---|---|
| EP | 0467101 | B1 | 3/1995 |
| EP | 0678469 | B1 | 11/1999 |
| JP | H07157199 | A | 6/1995 |
| WO | 9525835 | A1 | 9/1995 |

* cited by examiner

SYSTEM FOR THE LOADING OF YARN PACKAGES ON A CREEL ASSEMBLY

CROSS REFERENCE TO RELATED APPLICATION

This application is related to and claims priority benefits from European Patent Application No. 23315045.7 filed on Mar. 10, 2023, the contents of which are incorporated herein by reference.

FIELD

The present invention relates to the field of loading of yarn packages and more particularly to the field of loading of yarn packages on a creel assembly.

BACKGROUND

For the industrial processing of yarns, yarn is usually stored on a package wherein the yarn is wound around an axial bobbin along the entire length of the bobbin axis, so that the packages have a substantially cylindrical shape. The bobbin around which the yarn is wrapped is usually in the form of a cylindrical hollow tube so that the yarn package is able to be easily handled and engaged onto a bullhorn or a holder via this cylindrical hollow tube. In industrial processing, due to the large amount of yarns used in the processes to feed machines, the yarn wrapped around one single bobbin of the package has a sufficient length so that the complete unwinding of the yarn and the need to change the empty bobbins does not occur too soon. However, due to the amount of yarn wound around the bobbins, the yarn packages used for industrial processing may be large and very heavy so that their handling might be complicated and tedious. Indeed, the yarn packages may weigh up to 50 pounds or more.

To facilitate the carrying and handling of heavy yarn packages, several systems based on automated devices have been developed including a multi-axis robot with several degrees of freedom and a high flexibility. Because of their abilities for manipulating heavy items with accuracy, such multi-axis robots are very helpful for replacing empty bobbins on a creel by yarn packages. However, these multi-axis robots use articulated arms, one end of which being arranged to carry and manipulate the yarn packages. Holding a heavy yarn package at the end of an arm, more particularly when the arm is extended, creates tensions and significant stress on the joints of the articulated parts of the mechanism. In addition, the repetition of similar movements by the arm when carrying heavy yarn packages may generate rapid wear of the articulated joints and parts of the motorization. Further, multi-axis robots able to generate high power sufficient to support very heavy loads are expensive and usually have a high energy consumption, and robots capable of generating such high power are necessarily large in size, which creates physical restraints on the area housing such robots.

SUMMARY

The present invention aims to overcome these drawbacks by providing a system able to load yarn packages on a creel without requiring a motorization as powerful as that used by multi-axis robots.

The present invention concerns a system characterized in that the system comprises:

- a creel assembly comprising at least one lateral face having a plurality of receiving bullhorns arranged outwardly according to a horizontal axis to engage a respective yarn package,
- a loading device movable along a path arranged along the one lateral face of the creel assembly, the loading device comprising:
  - a detection means to identify the position of at least one empty receiving bullhorn of the creel assembly,
  - a positioning means to adjust the position of a bullhorn carrying a yarn package intended to be loaded onto the creel assembly so that the free end of this bullhorn is generally aligned with the free end of the at least one empty receiving bullhorn of the creel assembly,
  - a transfer mechanism for effecting translation of the yarn package from the carrying bullhorn to the empty receiving bullhorn of the creel assembly.

Additionally, the invention concerns a method of implementing a system according to the invention, characterized in that the method comprises:

- an identification step of the position of at least one empty receiving bullhorn of the creel assembly,
- a positioning step of a bullhorn carrying a yarn package to be loaded onto the creel assembly so that the free end of this bullhorn is generally aligned with the free end of the at least one empty receiving bullhorn of the creel assembly,
- a translation step of the carried yarn package from the carrying bullhorn to the empty receiving bullhorn of the creel assembly.

BRIEF DESCRIPTION OF THE DRAWINGS

The invention will be better understood from the following description, which refers to preferred embodiments, given as a non-limiting examples, and explained with references to the attached schematic drawings, in which.

DETAILED DESCRIPTION

Figure 1:
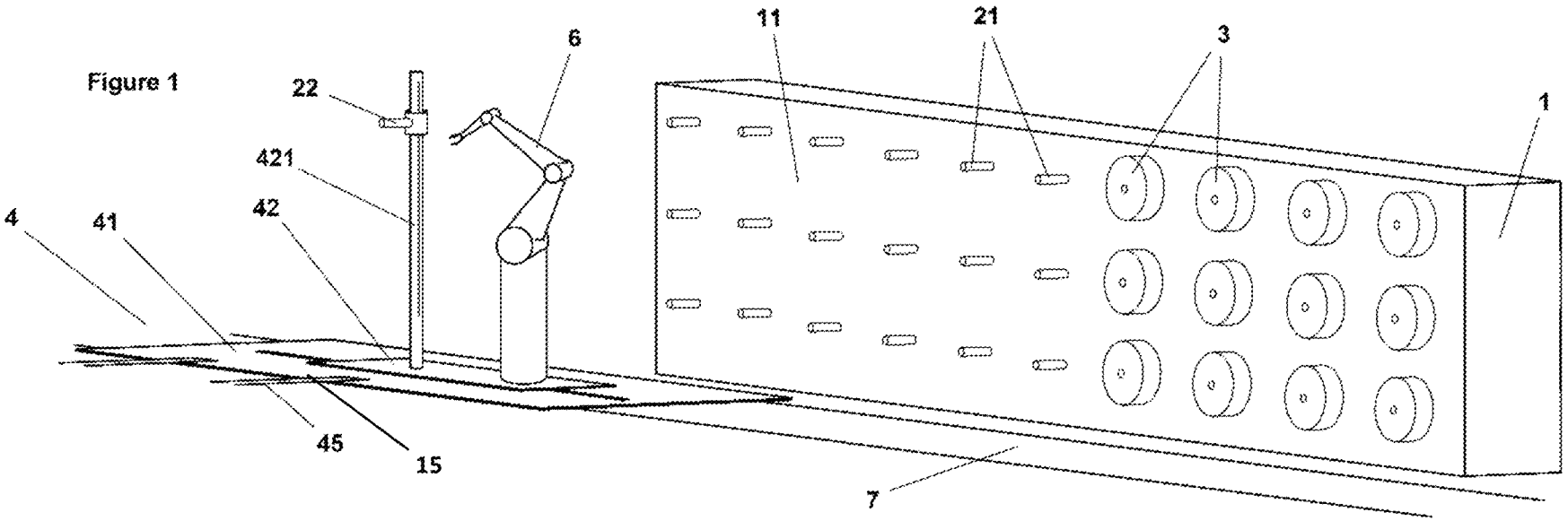
FIG. 1 is a schematic representation of an example of the system of the invention according to a point of view wherein the storage assembly is not shown.
Figure 2:
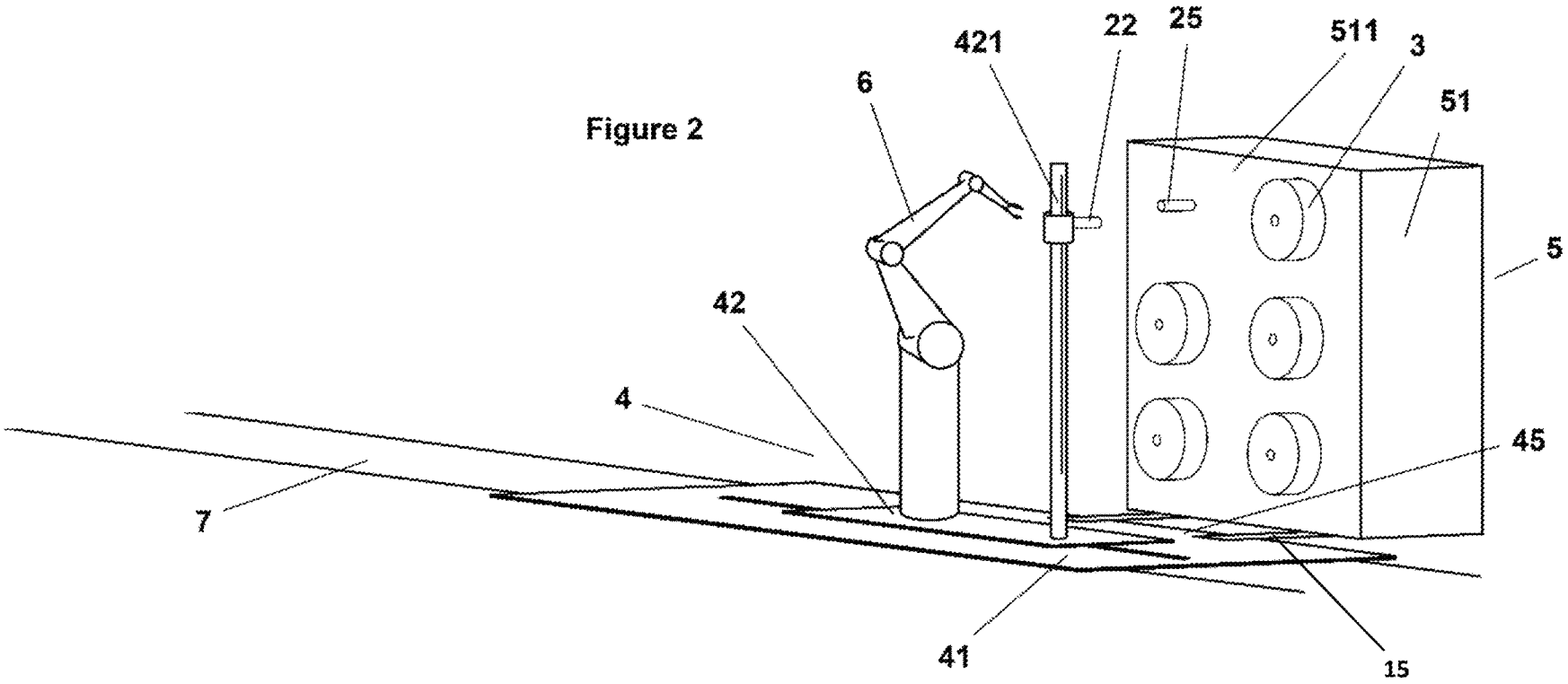
FIG. 2 is a schematic representation of an example of the system of the invention according to a point of view wherein the creel assembly is not shown.

The present invention concerns a system characterized in that the system comprises:

- a creel assembly 1 comprising at least one lateral face 11 having a plurality of receiving bullhorns 21 arranged outwardly according to a horizontal axis to engage a respective yarn package 3,
- a loading device 4 movable along a path 7 arranged along the one lateral face 11 of the creel assembly 1, the loading device 4 comprising:
  - a detection means to identify the position of at least one empty receiving bullhorn 21 of the creel assembly 1,
  - a positioning means to adjust the position of a bullhorn 22, 25 carrying a yarn package 3 intended to be loaded onto the creel assembly 1 so that the free end of this bullhorn 22, 25 is generally aligned with the free end of the at least one empty receiving bullhorn 21 of the creel assembly 1, a transfer mechanism 6 for effecting translation of the yarn package 3 from the carrying bullhorn 22, 25 to the empty receiving bullhorn 21 of the creel assembly 1.

In the system of the invention, the creel assembly is arranged so that at least axes of a plurality of the receiving bullhorns 21 of the creel assembly 1 are parallel with respect to each other. Because of such arrangement, the respective free ends of the receiving bullhorns 21 are positioned on this lateral face 11 of the creel assembly 1. By being movable along this lateral face 11 of the creel assembly 1, the loading device 4 of the system of the invention is movable along the respective free ends of the receiving bullhorns 21 of the creel assembly 1 and can be positioned in front of each of the receiving bullhorns 21. Thus, the loading device 4 is able to access the free end of each receiving bullhorn 21 on the lateral face 11 of the creel assembly 1 and engage the bobbin of a yarn package 3 on the free end of the empty receiving bullhorns 21. As the receiving bullhorns 21 may be positioned at a different height of the lateral face 11 of the creel assembly 1, the loading device 4 comprises means to vertically adjust the position of the bullhorns 22, 25 carrying the yarn package 3 with respect to the position of an empty receiving bullhorn 21 of the creel assembly 1. The positioning of the bullhorns 22, 25 carrying the yarn package 3 in front of the empty receiving bullhorn 21 of the creel assembly 1 is operated so that the hole at the end of the bobbin of the carried yarn package 3 is positioned in front of the free end of the empty receiving bullhorn 21 of the creel assembly 1, allowing the transfer of the yarn package 3 along the axis of the bullhorns 21, 22, 25. The yarn package 3 may be transferred along the axis of the bullhorns 21, 22, 25 by sliding or otherwise effecting linear movement. Such linear movement may be carried out using gravity, rollers, and/or bearings.

According to a preferred arrangement, the positioning of the bullhorns 22, 25 carrying the yarn package 3 is carried out so that the main axis of the bullhorn 22, 25 is generally aligned with the main axis of the empty receiving bullhorn 21 of the creel assembly 1. Thus, the alignment of the bullhorns 21, 22, 25 axis provides an easier transfer, for example by sliding, of the transferred yarn package 3 from the carrying bullhorn 22, 25 to the receiving bullhorn 21. The most the bullhorns 21, 22, 25 axes are aligned, the easiest is the transfer of the yarn package 3 from one bullhorn 22, 25 to another 21.

The system of the invention is arranged to limit the handling of the yarn package 3 between two bullhorns 21, 22, 25. Indeed, during its transfer from one bullhorn 22, 25 to an empty one 21 of the creel assembly 1, the yarn package 3 is permanently carried by at least one of the two bullhorns 21, 22, 25. By sliding or other linear movement, the bobbin of the yarn package 3 gradually disengages from the carrying bullhorn 22, 25 and simultaneously is gradually engaged on the bullhorn 23 of the creel assembly 1, so that the carrying of the yarn package 3 is temporary operated by the two bullhorns 21, 22, 25 partially engaged through respective ends of the bobbin of the yarn package 3. Consequently, in the system of the invention, the transfer mechanism 6 does not carry the transferred yarn package 3. The transfer mechanism 6 only actuates and/or provides the translation movement of the yarn package 3 from the carrying bullhorn 22, 25 to the empty bullhorn 21. To make such transfer easier, the positioning of the bullhorn 22, 25 carrying a yarn package 3 in front of the free end of the at least one empty receiving bullhorn 21 of the creel assembly 1 is arranged so that the space between the free ends of the two bullhorns 21, 22, 25 facing each other is smaller than the average length of the bobbins of the loaded yarn packages 3. Preferably, the space between the free ends of the two bullhorns 21, 22, 25 facing each other is smaller than half the average length of the bobbins of the loaded yarn packages 3. According to an example corresponding to a particular arrangement of the system, the carrying bullhorn 22, 25 may be positioned vertically above the empty receiving bullhorn 21 to utilize gravity in helping with the transfer of the yarn package 3. In these examples, the axes of the two bullhorns are still generally aligned, but are oriented at an angle relative to horizontal.

According to an example relative to a variant of the system of the invention that may be combined with the above-detailed variants of the invention, the loading device 4 comprises a frame 41 forming a structure on which several additional elements of the loading device 4 are mounted or attached. This frame 41 includes a structure supporting and/or carrying the detection means to identify one or several specific receiving bullhorns 21 of the creel assembly 1, the transfer mechanism 6 for sliding or otherwise translating the yarn package 3 from one bullhorn 22 to an empty one 21, and the positioning means for adjusting the position of the carrying bullhorn 22. Additionally, the frame 41 can be mounted on rolling elements intended to interact with the floor or with a guiding element of the path 7 of the loading device 4. Further, driving elements of the loading system 4 may be mounted on the frame 41. For example, the frame 41 may have the shape of a plane structure as shown on the figures. The frame 41 is preferably as large as its path 7 so that clutter problems for the installation of the system are avoided.

According to an example relative to a variant of the system of the invention that may be combined with at least one of the above-detailed variants of the invention, the path 7 for the loading device 4 along the lateral face 11 of the creel assembly 1 is formed by at least one guiding means, for example such as a railway, so that the loading device 4 is driven to roll or slide along this railway. The railway may be positioned on the floor so that the loading device 4 moves onto this railway or, alternatively, the railway may be mounted high up, for example on the ceiling, so that the loading device 4 moves along this railway while suspended. According to an alternative of this variant, the path of the loading device 4 may be a virtual path programmed and stored in a memory connected to an automated driving mechanism of the loading device 4. The memory and the driving mechanism may be placed remotely or embedded into the loading device 4.

According to another example relative to a variant of the system of the invention that may be combined with at least one of the above-detailed variants of the invention, the loading device 4 includes at least one yarn package storage assembly 5, so that the storage assembly 5 is movable with the loading device 4. Thus, the storage assembly 5 is carried by the frame 41 of the loading device 4 or even mounted on the frame 41. For example, this storage assembly 5 may include an embedded creel 51 with a plurality of parallel bullhorns 25 arranged outwardly so that the respective free ends of the bullhorns 25 are positioned on the same lateral face 511 of the embedded creel 51. The bullhorns 25 of the embedded creel 51 are loaded with respective yarn packages 3 intended to be loaded on respective bullhorns 21 of the creel assembly 1. In the loading device 4, the lateral face 511 of the embedded creel 51 is positioned relative to the lateral face of the creel assembly 1 having the free ends of the plurality of empty receiving bullhorns 21 intended to be loaded by the yarn packages 3. For example, the lateral face 511 of the embedded creel 51 may be positioned in front of the lateral face of the creel assembly 1. According to this alternative construction of the system, by movements vertically and/or horizontally along the path 7 arranged along the one lateral face 11 of the creel assembly 1, the positioning means of the loading device 4 adjusts the position of the free end of one of the bullhorns 25 of the embedded creel 51 so it is aligned with the free end of an identified empty receiving bullhorn 21 of the creel assembly 1 so that the yarn package 3 is able be loaded onto the receiving bullhorn 21. Then, the transfer mechanism of the loading device 4 causes the yarn package 3 to translate or otherwise slide from the bullhorns 25 of the embedded creel 51 of the loading device 4 to receiving bullhorn 21 of the creel assembly 1. In some embodiments, the yarn package storage assembly 5 is designed so the arrangement and positioning of the bullhorns 25 of the yarn package storage assembly mirrors the arrangement and positioning of the bullhorns 21 of the creel assembly 1, such that it may not be required to vertically adjust the position of the bullhorns 25 of the storage assembly 5.

According to another example relative to a variant of the system of the invention that may be combined with at least one of the above-detailed variants of the invention, the loading device 4 comprises a supply interface 45 that interacts with at least one yarn package storage assembly 5. The loading device 4 comprises at least one carrying bullhorn 22 between, on one side, the yarn package storage assembly 5 and, on the other side, the bullhorns 21 of the creel assembly 1. This supply interface 45 is arranged to allow engaging a yarn package 3 on a bullhorn 22 of the loading device 4 before it is loaded onto the creel assembly 1 by the loading device 4. The supply interface 45 and the creel assembly 1 are positioned on two different sides of the loading device 4 so that yarn packages 3 intended to be loaded on the creel assembly 1 can be engaged on the intermediate bullhorn 22 of the loading device 4 despite one side of the loading device 4 being positioned in front of the creel assembly 1. According to a preferred arrangement of this alternative construction, the supply interface 45 and the creel assembly 1 are positioned on opposite sides of the loading device 4. Such preferred arrangement avoids clutter problems with the creel assembly 1 and eventual guiding means or elements of the loading device 4 along its path 7. For example, the supply interface 45 and the creel assembly 1 may be positioned on different sides of the path 7 of the loading device 4.

According to another example relative to a variant of the system of the invention that may be combined with at least one of the above-detailed variants of the invention, the supply interface 45 comprises a bearing structure 15 to load at least one yarn package on the storage removable assembly 5. The bearing structure 15 of the supply interface 45 is arranged to removably load a yarn package storage assembly 5. The loading device 4 comprises a frame 41, the bearing structure 15 of the supply interface 45 is mounted on or is a part of this frame 41. For example, this bearing structure of the supply interface 45 corresponds to a plane structure arranged on a side of the frame 41 of the loading device 4 to support or carry at least one yarn package storage assembly 5. For example, this storage assembly 5 may include an embedded creel 51 with a plurality of parallel bullhorns 25 arranged outwardly so that the respective free ends of the bullhorns 25 are positioned on the same lateral face 511 of the embedded creel 51. Each bullhorn 25 of the embedded creel 51 is arranged by engaging respective yarn packages 3 intended to be loaded on respective bullhorns 21 of the creel assembly 1. In the loading device 4, the lateral face 511 of the embedded creel 51 is facing the intermediate bullhorn 22. The intermediate bullhorn 22 is movably mounted with respect to the frame 41 of the loading device 4, so that the position of the intermediate bullhorn 22 is adjustable with respect to each bullhorn 25 of the embedded creel 51, allowing the free end of the intermediate bullhorn 22 to be placed in front of or aligned with the respective free end of each bullhorn 25 of the embedded creel 51.

According to another example relative to a variant of the system of the invention that may be combined with at least one of the above-detailed variants of the invention, the loading device 4 comprises a carrying bullhorn 22 arranged to be movable between a first position wherein the intermediate bullhorn 22 is able to be loaded with a yarn package 3 and a second position wherein the free end of the intermediate bullhorn 2 is in front of the free end of the at least one empty receiving bullhorn 21 of the creel assembly 1. The intermediate bullhorn 22 of the loading device 4 is movable between a supply position to engage a yarn package 3 and a loading position to transfer the engaged yarn package 3 to a receiving bullhorn 21 of the creel assembly 1. Because the supply interface 45 and the creel assembly 1 are positioned on different sides of the loading device 4, the intermediate bullhorn 22 of the loading device 4 is arranged to move its engaged yarn package 3 between the two sides of the loading device 4.

According to another example relative to a variant of the system of the invention that may be combined with the above-detailed variants of the invention, the intermediate bullhorn 22 of the loading device 4 is mounted horizontally movable with respect to the frame 41 along an axis parallel to one side of the frame 41 or along an axis parallel to the lateral face 511 of the embedded creel 51 comprising the free ends of the bullhorns 25. According to an example for the construction of this variant, the intermediate bullhorn 22 is mounted on a support structure 42 carried by the frame 41 of the loading device 4 so that this support structure 42 is axially movable with respect to the frame 41. The support structure 42 may interact with the frame 41 through guiding means such as rails arranged along a length of the frame 41 of the loading device 4. Additionally, the support structure 42 may cooperate with a driving means to control the position of the support structure 42 with respect to the frame 41 or with respect to a particular part of the supply interface 45 or the embedded creel 51. Thus, in the loading device 4, the position of the intermediate bullhorn 22 can be horizontally and/or vertically adjusted to be in front of a particular bullhorn 25 of the embedded creel 51.

According to another example relative to a variant of the system of the invention that may complete the previous variant of the invention, the loading device 4 comprises:

- a vertical stalk 421; and
- the intermediate bullhorn 22 arranged according to a horizontal axis and extending outwardly from the vertical stalk 421 so that the end of the intermediate bullhorn 22 is mounted vertically movable along the vertical stalk 421 and horizontally pivotable around the axis of the vertical stalk 421.

According to another example relative to a variant of the system of the invention that may complete the previous variant of the invention, the intermediate bullhorn 22 of the loading device 4 is mounted vertically movable with respect to the frame 41 in order to make the position of the intermediate bullhorn 22 vertically adjustable to be placed in front of a particular bullhorn 25 of the embedded creel 51.

According to an example for the construction of this variant, by one of its ends, the intermediate bullhorn 22 is movably mounted on a vertical stalk 421 of the support structure 42 forming a vertical guiding means, for example a vertical rail or a vertical rack, so that the intermediate bullhorn 22 may roll or slide along this vertical stalk 421. Additionally, the intermediate bullhorn 22 may cooperate with a driving means to control the position of the intermediate bullhorn 22 along this vertical stalk 421 or with respect to a particular part of the supply interface 45 or the embedded creel 51 or with respect to a particular part of the creel assembly 1. In combination the horizontal movement of the intermediate 22 provided by the movement of the loading device 4 along its path 7 or by the movement of the support structure 42 with respect to the frame 41 of the loading device 4, the vertical translation of the intermediate bullhorn 22 along the vertical stalk 421 of the loading device 4 completes the translation of the intermediate bullhorn 22 in any direction of a vertical plane parallel to a plane comprising the vertical stalk 421 and the horizontal axis of the translation provided by the path 7 or the guiding means of the support structure 42 with respect to the frame 41 of the loading device 4. Thus, the position of the intermediate bullhorn 22 can be vertically and horizontally adjusted to be in front of a particular bullhorn 21, 25 positioned at any place on the lateral face 11, 511 of the creel assembly 1 or of the embedded creel 51. These adjustments are operated by vertical and/or horizontal translations of the intermediate bullhorn 22 with respect to the frame 41 of the loading device 4 in a vertical plane.

According to another example relative to a variant of the system of the invention that may complete the previous above-detailed variants of the invention, as the supply interface 45 and the creel assembly 1 are positioned on different sides of the loading device 4, the intermediate bullhorn 22 of the loading device 4 is arranged to move its engaged yarn package 3 between the two sides of the loading device 4. According to an example for the construction of this variant, by one of its ends the intermediate bullhorn 22 is movably mounted in a horizontal plane by pivoting around a vertical stalk 421 so that the intermediate bullhorn 22 is able to alternatively position its free end in the direction of two different sides of the loading device 4. Thus, the free end of the intermediate bullhorn 22 can be positioned on the side of the supply interface 45, in front of the free end of the bullhorn 25 of the embedded creel 51 to be loaded with a yarn package 3. Next, after pivoting around a vertical stalk 421, the intermediate bullhorn 22 can be positioned on the side of the creel assembly 1, in front of the free end of an empty receiving bullhorn 21. Additionally, the intermediate bullhorn 22 may cooperate with a driving means to control the position of the intermediate bullhorn 22 around this vertical stalk 421 or with respect to a particular part of the supply interface 45 or of the loading interface 4. Thus, in the loading device 4, the position of the intermediate bullhorn 22 can be horizontally adjusted around a vertical stalk 421. This adjustment is operated by a pivoting movement of the intermediate bullhorn 22 with respect to the frame 41 of the loading device 4 in a horizontal plan.

According to a preferred construction of the example relative to the previous above-detailed variant of the invention, the length of the intermediate bullhorn 22 is long enough so that its free end is able to cooperate, on one side of the loading device 4, with the free end of the bullhorn 25 of the embedded creel 51 and, on the other side of the loading device, with the free end of a receiving bullhorn 21 of the creel assembly 1. Depending on the width of the vertical stalk 421 positioned at equal distance between the free end of the bullhorn 25 of the embedded creel 51 and the free end of a receiving bullhorn 21 of the creel assembly 1, the length of the intermediate bullhorn 22 is at most half the distance between the free end of the bullhorn 25 of the embedded creel 51 and the free end of a receiving bullhorn 21 of the creel assembly 1 positioned in front of the corresponding bullhorn 25 of the embedded creel 51.

It must be noticed that, during its movements in vertical or horizontal planes, the inclination of the main axis of the intermediate bullhorn 22 with respect to the horizontal plane is constant and not modified. Preferably, the main axis of the intermediate bullhorn 22 is positioned in a horizontal plane. Thus, once the bobbin of a yarn package 3 is engaged on the intermediate bullhorn 22, the vertical and/or horizontal translations of the intermediate bullhorn 22 with respect to the frame 41 of the loading device 4 do not affect the engagement of the yarn package 3 on the intermediate bullhorn 22 by an undesired leaving of the carried yarn package 3. Similarly, the pivoting movement in a horizontal plane of the intermediate bullhorn 22 around a vertical stalk 421 does not affect the engagement of the yarn package 3 on the intermediate bullhorn 22. Indeed, despite the centrifugal force, the weight of the yarn package 3 is sufficient to maintain its engagement on the intermediate bullhorn 22 without an undesired sliding of the carried yarn package 3. According to another example relative to a particular variant of the system of the invention, the free end of the intermediate bullhorn 22 comprises a locking mechanism to maintain the bobbin of a yarn package 3 engaged on the intermediate bullhorn 22 and avoid any undesired sliding of the bobbin. According to another example relative to a particular variant of the system of the invention, the main axis of the intermediate bullhorn 22 is angled with respect to the horizontal plane. By having the free end of the intermediate bullhorn 22 positioned vertically lower than its other end, the sliding by gravity of the yarn package 3 from the intermediate bullhorn 22 is easier. A locking mechanism at the free end of the intermediate bullhorn 22 maintains the engagement of the bobbin of a yarn package 3 on the intermediate bullhorn 22 and avoids its undesired sliding. According to particular example of this variant of the system of the invention, the main axis of the intermediate bullhorn 22 is angularly movable with respect to the horizontal plane so that the free end of the intermediate bullhorn 22 is able to be alternatively positioned vertically upper or lower than its other end. Thus, the yarn package 3 may slide easily by gravity along the intermediate bullhorn 22 for its engagement or its disengagement from this bullhorn 22.

According to another example relative to a variant of the system of the invention that may be combined with at least one of the above-detailed variants of the invention, the transfer mechanism 6 comprises a pushing means movable according to the axis of the carrying bullhorn 22. This pushing means is arranged to interact with the surfaces of the yarn package 3 having a hole of the bobbin.

According to a first example for the construction of the above-detailed variant of the system, the pushing means of the transfer mechanism 6 is a multi-axis arm or an articulated arm with several degrees of freedom, for example a multi-axis robot, so that, because of its high flexibility, the free end of the arm is able to operate the required push on the concerned surface of the yarn package 3 at least for its disengagement from the intermediate carrying bullhorn 22 and its engagement on the receiving bullhorn 21 of the creel assembly 1. The high flexibility of the arm allows its free end of the arm to operate an additional required push for transferring the yarn package 3 from the supply interface 45 to the carrying bullhorn 22 of the loading device 4. According to a preferred construction, this transfer mechanism 6 formed by a multi-axis arm or an articulated arm is mounted onto the frame 41 of the loading device 4 to be moved with the carrying bullhorn 22 and the engaged yarn package 3 with respect to the creel assembly 1 along the path 7. More preferably, the multi-axis arm of the transfer mechanism 6 is mounted on a part of the support structure 42 so that the arm can be moved with the carrying bullhorn 22 and the engaged yarn package 3 with respect to the frame 41 of the loading device 4.

According to a second example for the construction of the pushing means of the transfer mechanism 6 of the variant of the system, the pushing means is a motorized telescopic rod mounted by one of its ends on the loading device 4. The pushing means is mounted with the intermediate carrying bullhorn 22 on the loading device 4, so that the axis of the telescopic rod is kept parallel to the main axis of the intermediate carrying bullhorn 22. The telescopic rod is mounted close to the intermediate carrying bullhorn 22 and its free end comprises a surface to interact with the yarn package 3 carried by the intermediate carrying bullhorn 22. Thus, the extension of the telescopic rod causes its free end to push against the surface of the yarn package 3 and disengage the yarn package 3 from the intermediate carrying bullhorn 22. On the contrary, the retraction of the telescopic rod allows the engagement of a yarn package 3 on the intermediate carrying bullhorn 22. Similar telescopic rod can be mounted with the bullhorns 25 of the embedded creel 51 for the supply of the intermediate carrying bullhorn 22 with a yarn package 3 intended to be loaded on the creel assembly 1. Further, similar telescopic rod can be mounted with the receiving bullhorns 21 of the creel assembly 1 so that the empty bobbins engaged on receiving bullhorns 21 are ejected or disengaged from the creel assembly 1.

According to an example corresponding to a preferred construction of the system, the transfer mechanism 6 is connected to a movement control mechanism. This movement control mechanism may cooperate with a connected memory to provide an automation of the multi-axis arm and of the transfer mechanism 6. Additionally, this movement control mechanism may cooperate with one or several sensors to control the respective positions of the intermediate carrying bullhorn 22 and of the engaged yarn package 3 and to detect the position of the free end of the receiving bullhorn 21 of the creel assembly 1. The memory and the movement control mechanism may be placed remotely or embedded into the loading device 4.

The present invention further concerns a method of implementing a system according to the invention, characterized in that the method comprises:

an identification step of the position of at least one empty receiving bullhorn 21 of the creel assembly 1, a positioning step of a bullhorn 22, 25 carrying a yarn package 3 intended to be loaded onto the creel assembly 1 so that the free end of this bullhorn 22, 25 is generally aligned the free end of the at least one empty receiving bullhorn 21 of the creel assembly 1, after such positioning step, a translation step of the carried yarn package 3 from the carrying bullhorn 22, 25 to the empty receiving bullhorn 21 of the creel assembly 1.

This translation step is preferably carried out by the sliding of the yarn package 3 from one first bullhorn 22, 25 to the second one 21.

According to an example relative to a variant of the method of the invention wherein the loading device 4 of the system comprises an intermediate bullhorn 22, the method comprises:

a loading step of the carrying bullhorn 22 with a yarn package 3 from a storage assembly 5, a moving step of the loaded carrying bullhorn 22 with respect to the frame structure 41 of the loading device 4.

According to another example relative to a variant of the system of the invention that may be combined with at least one of the above-detailed variants of the invention, the positioning step is carried out so that the main axis of the bullhorn 22, 25 of the loading device 4 carrying a yarn package 3 is aligned on the main axis of the at least one empty receiving bullhorn 21 of the creel assembly 1.

According to another example relative to a variant of the system of the invention that may be combined with at least one of the above-detailed variants of the invention, the positioning step of the bullhorn 22, 25 carrying a yarn package 3 to generally align with the free end of the at least one empty receiving bullhorn 21 of the creel assembly 1 is operated so that the space between the free ends of the two bullhorns 21, 22, 25 facing each other is smaller than the average length of the bobbins of the loaded yarn packages 3. Preferably, the space between these free ends is smaller than half the average length of the bobbins of the loaded yarn packages 3.

According to another example relative to a variant of the system of the invention that may be combined with at least one of the above-detailed variants of the invention the sliding step of the carried yarn package 3 is operated by a pushing means.

The present invention is not limited to the embodiment described and shown in the attached drawings. Modifications remain possible, in particular from the point of view of the constitution of the various elements or by substitution of technical equivalents, without however leaving the field of protection of the invention.

That which is claimed is:

1. A system comprising:

a creel assembly comprising at least one lateral face having a plurality of receiving bullhorns arranged outwardly along a horizontal axis to engage a respective yarn package; and a loading device movable along a path arranged along the one lateral face of the creel assembly, the loading device comprising:

a vertical stalk, a carrying bullhorn realized by an intermediate bullhorn arranged according to a horizontal axis and extending outwardly from the vertical stalk so that the end of the intermediate bullhorn is mounted vertically movable along the vertical stalk and horizontally pivotable around the axis of the vertical stalk, this intermediate bullhorn being arranged to be movable between a first position wherein the intermediate bullhorn is able to be loaded with a yarn package and a second position wherein the free end of the intermediate bullhorn is generally aligned with the free end of the at least one empty receiving bullhorn of the creel assembly, and a transfer mechanism for effecting translation of the yarn package from the carrying bullhorn to the empty receiving bullhorn of the creel assembly, wherein the loading device is configured to;

adjust the position of a bullhorn carrying a yarn package intended to be loaded onto the creel assembly so that the free end of this bullhorn is generally aligned with the free end of the at least one empty receiving bullhorn of the creel assembly;

identify the position of at least one empty receiving bullhorn of the creel assembly; and translate, using the transfer mechanism, the yarn package from the carrying bullhorn to the empty receiving bullhorn of the creel assembly.

2. The system according to claim 1, wherein the transfer mechanism is movable according to the axis of the carrying bullhorn.

3. The system according to claim 1, wherein the loading device comprises a supply interface that interacts with at least one yarn packages storage assembly.

4. The system according to claim 3, wherein the supply interface comprises a bearing structure for loading at least one yarn package storage removable assembly.

5. The system according to claim 3, wherein the supply interface and the creel assembly are positioned on opposite sides of the loading device.

6. A method of implementing the system according to claim 1, wherein the method comprises:

an identification step of the position of at least one empty receiving bullhorn of the creel assembly;

a positioning step of a bullhorn carrying a yarn package intended to be loaded onto the creel assembly so that the free end of this bullhorn is generally aligned with the free end of the at least one empty receiving bullhorn of the creel assembly; and a translation step of the carried yarn package from the carrying bullhorn to the empty receiving bullhorn of the creel assembly.

7. The method according to claim 6, wherein the loading device of the system comprises an intermediate bullhorn, and where the method comprises:

a loading step of the carrying bullhorn with a yarn package from a storage assembly; and a moving step of the loaded carrying bullhorn with respect to the frame structure of the loading device.

8. The method according to claim 6, wherein the positioning step is carried out so that the main axis of the bullhorn of the loading device carrying a yarn package is aligned on the main axis of the at least one empty receiving bullhorn of the creel assembly.

9. The method according to claim 5, wherein the positioning step of the bullhorn carrying a yarn package to generally align with the free end of the at least one empty receiving bullhorn of the creel assembly is operated so that the space between the free ends of the two bullhorns is smaller than the average length of the bobbins of the loaded yarn packages.

10. The method according to claim 6, wherein the translating step of the carried yarn package is operated by a sliding or pushing means.

* * * * *